US008153936B2

(12) United States Patent
Kernwein et al.

(10) Patent No.: US 8,153,936 B2
(45) Date of Patent: Apr. 10, 2012

(54) METHOD FOR THE HEATING UP OF A CERAMIC GLOW PLUG

(75) Inventors: Markus Kernwein, Bretten-Büchig (DE); Jörg Stöckle, Ludwigsburg (DE); Olaf Toedter, Walzbachtal (DE); Ganghua Rüan, Stuttgart (DE); Marc Rottner, Illingen (DE)

(73) Assignee: BERU Aktiengesellschaft, Ludwigsburg (DE)

( * ) Notice: Subject to any disclaimer, the term of this patent is extended or adjusted under 35 U.S.C. 154(b) by 837 days.

(21) Appl. No.: 12/215,982

(22) Filed: Jun. 30, 2008

(65) Prior Publication Data

US 2009/0008378 A1 Jan. 8, 2009

(30) Foreign Application Priority Data

Jul. 6, 2007 (DE) ..... 10 2007 031 943
Aug. 13, 2007 (DE) ..... 10 2007 038 131

(51) Int. Cl.
*F23Q 7/04* (2006.01)

(52) U.S. Cl. ..... 219/260

(58) Field of Classification Search ..... 219/260–270
See application file for complete search history.

(56) References Cited

U.S. PATENT DOCUMENTS

| | | | | |
|---|---|---|---|---|
| 4,260,985 | A | 4/1981 | Hayden | |
| 4,283,619 | A | 8/1981 | Abe | |
| 4,300,491 | A | 11/1981 | Hara et al. | |
| 4,594,975 | A | 6/1986 | Shigenobu | |
| 4,607,153 | A | 8/1986 | Ang et al. | |
| 4,939,347 | A * | 7/1990 | Masaka et al. | 219/492 |
| 5,075,536 | A | 12/1991 | Towe et al. | |
| 5,084,606 | A | 1/1992 | Bailey et al. | |
| 5,122,968 | A | 6/1992 | Bauer et al. | |
| 5,664,540 | A | 9/1997 | Matsuoka et al. | |
| 5,777,764 | A | 7/1998 | Kohn | |
| 2004/0255889 | A1 | 12/2004 | Kumada et al. | |
| 2010/0050275 | A1 | 2/2010 | Burch et al. | |
| 2010/0094523 | A1 | 4/2010 | Kernwein et al. | |

FOREIGN PATENT DOCUMENTS

| | | | |
|---|---|---|---|
| DE | 197 18 750 | A1 | 11/1997 |
| DE | 199 36 729 | C1 | 11/2000 |
| EP | 1 410 952 | A2 | 4/2004 |
| JP | 5106546 | | 4/1993 |
| WO | WO 91 18245 | | 11/1991 |

OTHER PUBLICATIONS

MTZ Motortechnische Zeitschrift 61 (2000) 10.

* cited by examiner

*Primary Examiner* — Daniel L Robinson

(57) ABSTRACT

Herein is described a method for the heating-up of a ceramic glow plug by applying a variable electric voltage to the glow plug. In accordance with the invention it is provided that, starting from a base value, the electric voltage increases in a time-averaged manner superproportional to the elapsed heating-up time. The invention relates also to a glow plug control unit for carrying out of such a method.

17 Claims, 3 Drawing Sheets

METHOD FOR THE HEATING UP OF A CERAMIC GLOW PLUG

The invention relates to a method for heating up of a ceramic glow plug and to a glow plug control unit for carrying out of such a method.

In order to start an engine, the glow plugs must be heated up as promptly as possible to a typical operating temperature of 1000° C. to 1300° C. If during the heating up process the operating temperature is overshot, the glow plug is subjected to increased wear and, in extreme cases, it can even be damaged. In order to prevent an overshooting, it is known to gradually reduce the electric voltage applied to the glow plug during the heating-up process (MTZ 61, 200, 10).

In spite of a very promising potential, ceramic glow pugs have hitherto not achieved the hoped for long service life.

The object of the invention is to show a manner in which ceramic glow plugs can be heated up as rapidly as possible to their operating temperature under the least possible load so that, by the heating them up, their service life is impaired as little as possible.

SUMMARY OF THE INVENTION

In accordance with the invention, this object is achieved by a method with the features set forth in claim 1. Furthermore, the object is achieved by means of a glow plug control unit according to claim 19 that is designed in such manner that, during operation, it carries out such a method to heat a glow plug up.

In prior art heating-up processes, in order to prevent an overshooting of the temperature of the glow plug, the applied voltage is reduced in a stepwise manner during the heating-up process, so that the electric voltage decreases in a time-averaged manner during the heating-up process. Surprisingly, the service life of ceramic glow plugs, especially outside heating glow plugs, can be increased by doing exactly the opposite. Because in accordance with the invention, at the beginning of the heating-up process, a running mean of the electric voltage increases superproportionally to the elapsed heating-up time.

Preferably, the running mean of the electric voltage over a running time interval of at most 0.3 seconds, preferably at most 0.2 seconds, especially at most 0.1 second, should increase in a superproportional manner with respect to the elapsed heating-up time.

By way of example, the electric voltage can be continuously increased at the beginning of a heating-up process. Preferably the electric voltage is increased in steps, whereby in such a case the height of the steps increases with increasing time and/or the width of the steps decreases with increasing time. Thereby, a course of the electric voltage results that, in a time-averaged manner, increases super-proportionally during the heating-up phase.

While in prior art, at the onset of the heating-up process, the full voltage of the vehicle's electrical system is typically applied to the glow plug, it is preferable according to the present invention to apply at first a significantly lower starting voltage of, e.g., 6 volts, as base value. Starting from the base value, the electric voltage is then increased up to a maximum value, which could be the nominal value of the vehicle's electrical system. The base value is preferably at least 4 volts, especially at least 5 volts. Preferably, at the onset of the process, the base value is driven and reached in a single jump from zero, e.g., by means of a starting cycle.

The surprisingly positive effect of the method according to the invention on the service life of ceramic glow plugs may be attributed to the fact that local current paths are generated in the ceramic conductor of a ceramic glow plug which, when applying an excessive voltage, might perhaps lead to a local overheating and thus to a damage of the glow plugs. Caused by the temperature, the electric resistance increases during the heating-up process so that, in order to heat up to a desired operating temperature as rapidly as possible, the electric voltage can also be increased without damaging the material. It seems that especially the onset of the heating-up process is critical for the service life of the glow plug. In order to attain the most rapidly possible heating-up, the voltage should be increased progressively according to the invention up to a maximum during the heating-up phase and after having reached the maximum, it can eventually be decreased in a delayed manner to a lower value, which suffices to maintain the desired operating temperature.

As mentioned, the voltage can be gradually increased at the onset of the heating-up process. Preferably, the electric voltage remains constant during a time period of at most 0.4 seconds, especially at the most during 0.2 seconds, and especially preferred at the most during a time period of 0.1 second, before it is increased in a consecutive time period.

The electric voltage of a car battery is preferably applied in a pulse-width modulation process for short time slices, so that there is generated an effective voltage whose course in time can be a step function, a polygonal course or, e.g., parabolic, and in a time-averaged manner increases superproportional to the elapsed heating-up time. Often, the effective voltage provided by a pulse-width modulation process is simply called voltage.

A continuous increase of the effective voltage can be achieved by a process of pulse width modulation by increasing the width of the time slices, i.e. the length of time period $\Delta t_1$ during which voltage is applied, and/or by reducing the length of the time period $\Delta t_2$ between these time slices. The effective voltage at a time t can be calculated as a running mean over the applied voltage during a time period which has a length of $\Delta t_1+\Delta t_2$ and is centered on t.

Especially good results can be obtained by increasing the effective electric voltage in a continuous or semi-continuous manner, starting from a starting voltage. For example, the course of the electric voltage over time may approximate a polygonal course. The more intermediate points the polygon has, the more uniform is the increase of the voltage. The polygonal course has preferably at least 5 intermediate points, especially at least 8 intermediate points, and especially preferably 12 intermediate points. It is especially advantageous if the course of the electric voltage approximates a continuously differentiable function and the time derivative of course of the electric voltage increases in a strictly monotonic manner. For example, the effective electric voltage may show a parabolic increase.

A glow plug control unit in accordance with the invention is designed in such a manner that for heating-up of a glow plug it carries out the method according to the invention. Preferably, the glow plug control unit has a memory in which are stored at least 5 intermediate points of a programmed curve for the course of electric voltage to follow during the heating-up process. Especially preferred is that at least 8 intermediate points of the programmed curve are stored.

BRIEF DESCRIPTION OF THE DRAWINGS

Further details and advantages of the invention are explained by way of an embodiment, making reference to the accompanying illustrations.

DETAILED DESCRIPTION

Figure 1:
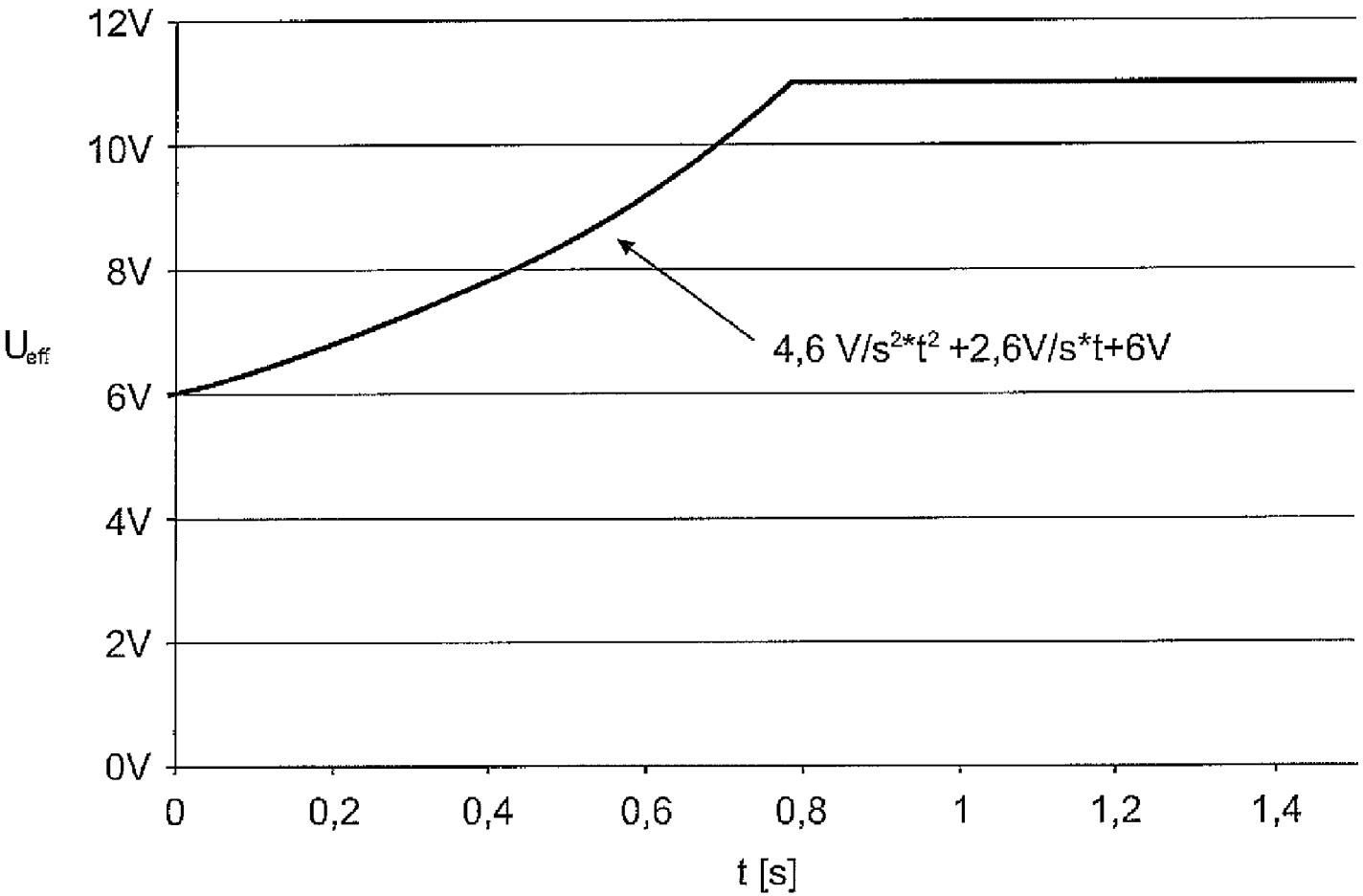
FIG. 1 shows an example of the course of the effective voltage of a ceramic glow plug during the heating-up process.

FIG. 1 shows the course of the effective voltage Ueff in volts over time t in seconds. The voltage is applied to a ceramic glow plug to heat it up to an operating temperature for starting of a motor. At the onset of a heating-up process the effective voltage is applied as a starting voltage which is smaller than the voltage of the vehicle's electrical system, which is today usually about 12V. The starting voltage, which is larger than zero, is chosen as a base value and preferably reached in a jump.

Thereby a method is realized for heating-up of a ceramic glow plug to an operating temperature for the starting of a motor. During the method a variable voltage is applied to the glow plug. Starting from a base value the voltage increases superproportional to the elapsed heating-up time until a maximum value is reached.

In FIG. 1 it is shown that the effective voltage Ueff increases in a parabolic manner from a base value of 6 volts to a maximum value of about 11 volts. The voltage course follows a programmed curve $Ueff(t)=4.6\ (Volt/s^2)\times t^2+2.6\ (V/s)\times t+6\ V$. In that formula time t is to be entered in seconds which are abbreviated by s. Ueff(t) is the effective voltage applied to the glow plug as a function of time.

The given effective voltage Ueff is applied by the glow plug control unit to the glow plug by means of a pulse width modulation process.

In a pulse width modulation process a vehicle's electrical power supply is applied to a glow plug in voltage pulses for short periods of time. The duration of the voltage pulses and the duration of breaks between the pulses determine the effective voltage. For example, the effective voltage may be calculated as a running mean of the voltage applied. The mean is calculated over a period of time which is the sum of the duration $\Delta t_1$ of a voltage pulse and of a consecutive period of time $\Delta t_2$ during which the glow plug is disconnected from the power supply. Considering the voltage of the power supply as approximately constant, the effective voltage Ueff in a time period $\Delta t_1+\Delta t_2$ is $$Ueff=(U_B\cdot\Delta t_1):(\Delta t_1+\Delta t_2)$$

Figure 2:
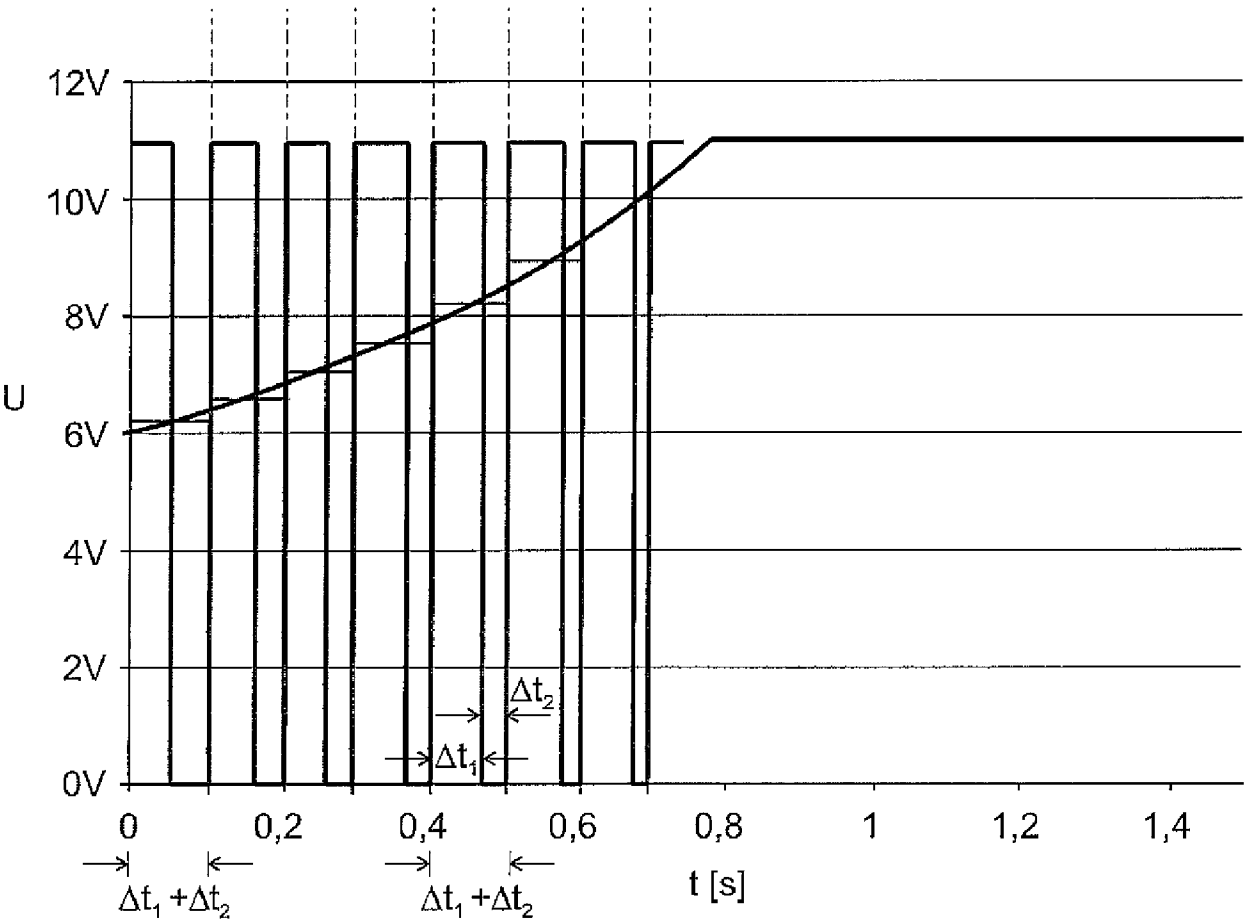
FIG. 2 shows the voltage pulses applied by a pulse width modulation process together with the resulting course of the effective voltage shown in FIG. 1.

FIG. 2 shows the voltage pulses applied by the pulse width modulation process as well as the resulting course of the effective voltage shown in FIG. 1. The duration $\Delta t_1$ of the voltage pulses increases with increasing time in a superproportional manner, that i.e. faster than in a proportional manner. The duration $\Delta t_2$ of the breaks between the voltage pulses decreases accordingly such that the sum of $\Delta t_1$ and $\Delta t_2$ is constant.

The sum of the duration of a voltage pulse and a consecutive time period during which the glow plug is disconnected from the vehicle's power supply is 0.1 second in the example shown. The onset of a voltage pulse is highlighted in FIG. 2 by a broken line on the upper fringe of the figure. The voltage that was applied on average over the time period $\Delta t_1+\Delta t_2$ is marked in FIG. 2 for the points in time 0.05 s, 0.15 s, 0.25 s, 0.35 s, 0.45 s and 0.55 s by horizontal lines. Therefore, the horizontal lines mark the effective voltage after time 0.05 s, 0.15 s, 0.25 s, 0.35 s, 0.45 s and 0.55 s.

The described course of the voltage facilitates a quick heating-up of a glow plug without impairing its service life. Shortly after a maximum effective voltage is applied to the glow plug it reaches its operating temperature. The maximum effective voltage is usually the nominal voltage of a vehicle's power supply but might be lower. After the operating temperature is reached the effective voltage may be lowered to a value sufficient for maintaining the operating temperature. The lowering of the effective voltage may be effected in steps or continuously.

Figure 3:
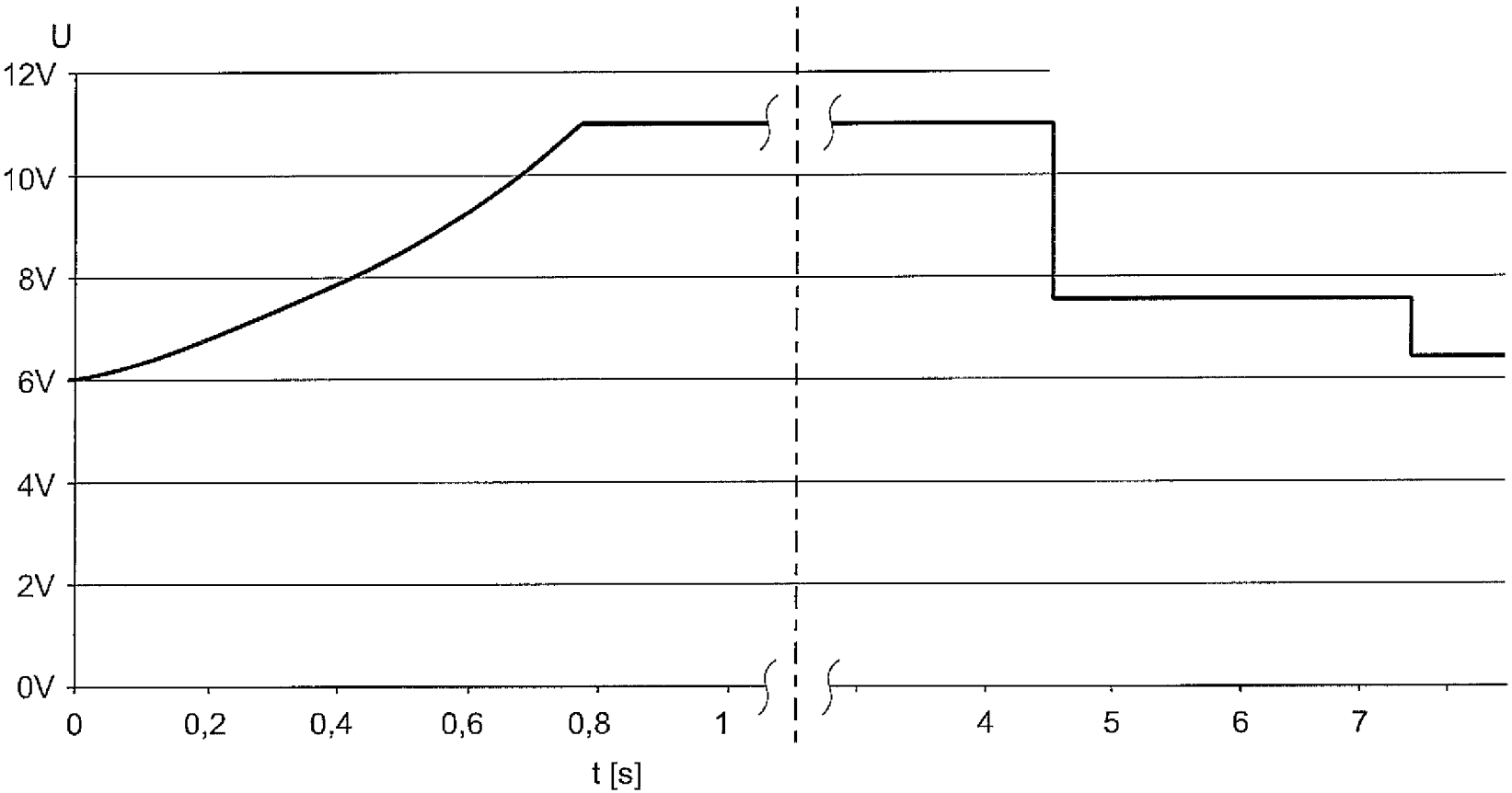
FIG. 3 shows an example of the course of the effective voltage during the heating-up of a glow plug to its operating temperature and the course of the effective voltage after the operating temperature is reached.

FIG. 3 shows schematically an example of the course of the effective voltage after a glow plug has been heated up by a process of the invention. The left half of FIG. 3 shows the course of the effective voltage as shown in FIG. 1. The right half of FIG. 3 shows how the effective voltage is lowered in steps to a value sufficient for maintaining the operating temperature. The scale on the abscissa is larger in the right half of FIG. 3 than in the left half of the figure.

What is claimed is:

1. A method for heating-up of a ceramic glow plug by applying a variable electric voltage to the glow plug, wherein a running mean of the electric voltage increases superproportional to the elapsed heating-up time; and during the heating-up process the electric voltage remains constant during a time period of at the most 0.4 seconds.

2. A method according to claim 1, wherein the increase of the electrical voltage starts from a base value.

3. A method according to claim 1, wherein the voltage is an effective voltage provided by a pulse width modulation process.

4. A method according to claim 1, wherein the electric voltage increases continuously.

5. A method for heating-up of a ceramic glow plug by applying a variable electric voltage to the glow plug, wherein a running mean of the electric voltage increases superproportional to the elapsed heating-up time, and wherein the electric voltage is increased in steps, whereby a height of the steps increases with increasing time and/or the width of the step decreases with increasing time.

6. A method according to claim 1, wherein the electric voltage is increased in steps, whereby the width of the step decreases with increasing time.

7. A method according to claim 1, wherein the electric voltage increases to a maximum and after reaching the maximum decreases to a lower value.

8. A method for heating-up of a ceramic glow plug by applying a variable electric voltage to the glow plug, wherein a running mean of the electric voltage increases superproportional to the elapsed heating-up time, and wherein the running mean of the electric voltage over a running time interval is at most 0.3 seconds.

9. A method according to claim 1, wherein the running mean of the electric voltage over a running time interval of at most 0.2 seconds increases in a superproportional manner to the elapsed heating-up time.

10. A method according to claim 1, wherein the running mean of the electric voltage over a running time interval of at most 0.1 second increases in a superproportional manner to the elapsed heating-up time.

11. A method according to claim 2, wherein the base value is at least 4 volts.

12. A method according to claim 2, wherein the base value is at least 5 volts.

13. A method according to claim 2, wherein at the onset of the method the base value is set in a single jump from zero to the base value.

14. A method according to claim 1, wherein the electric voltage increases in a parabolic manner.

15. A method according to claim 1, wherein the course of the electric voltage has a time derivative which exhibits a strictly monotonic increase.

16. A method according to claim 1, wherein the course of the electric voltage is a polygonal course.

17. A method according claim 1, wherein the polygonal course has at least five intermediate points.

* * * * *